US005975513A

United States Patent [19]

Wolfe

[11] Patent Number: 5,975,513

[45] Date of Patent: Nov. 2, 1999

[54] VISE WITH WORKPIECE HOLD DOWN FORCE

[75] Inventor: Ingo E. Wolfe, Brooklyn Park, Minn.

[73] Assignee: Kurt Manufacturing Company, Inc., Fridley, Minn.

[21] Appl. No.: 08/947,985

[22] Filed: Oct. 9, 1997

Related U.S. Application Data

[60] Provisional application No. 60/028,277, Oct. 11, 1996.

[51] Int. Cl.[6] ..... B25B 1/20

[52] U.S. Cl. ..... 269/136; 269/134

[58] Field of Search ..... 269/134, 135, 269/136, 137, 138, 244, 250, 251, 285, 73

[56] References Cited

U.S. PATENT DOCUMENTS

| | | | |
|---|---|---|---|
| 1,848,617 | 3/1932 | Friedrich . | |
| 2,247,656 | 7/1941 | Friedrich . | |
| 2,744,430 | 5/1956 | McLaughlin et al. . | |
| 2,861,492 | 11/1958 | Hokanson | 269/136 |
| 2,880,638 | 4/1959 | Muggli et al. . | |
| 3,186,706 | 6/1965 | De Felice . | |
| 3,325,161 | 6/1967 | Irish | 269/47 |
| 3,514,092 | 5/1970 | Lassy . | |
| 3,531,100 | 9/1970 | Stromquist . | |
| 4,043,547 | 8/1977 | Glomb et al. . | |
| 4,098,500 | 7/1978 | Lenz | 269/244 |
| 4,114,868 | 9/1978 | Smith . | |
| 4,223,879 | 9/1980 | Wolfe et al. . | |
| 4,411,415 | 10/1983 | Denaro . | |
| 4,958,818 | 9/1990 | Buchter . | |
| 5,163,662 | 11/1992 | Bernstein | 269/136 |

FOREIGN PATENT DOCUMENTS

| | | |
|---|---|---|
| 1 447 717 | 6/1966 | France . |
| 2 447 780 | 2/1979 | France . |
| 23 18 147 | 10/1974 | Germany . |
| 685257 | 12/1952 | United Kingdom . |

OTHER PUBLICATIONS

Trade Publication, The American Machinist, "Gier Down–Grip Vise", Mar. 1946.

*Primary Examiner*—David A. Scherbel
*Assistant Examiner*—Daniel G. Shanley
*Attorney, Agent, or Firm*—Westerman, Champlin & Kelly, P.A.

[57] ABSTRACT

A vise has a fixed jaw mounted stationarily relative to a vise body. A movable jaw is supported on side rails that have upper way surfaces. A jaw nut that exerts a downward force on the movable jaw operated to move the movable jaw along the way surfaces. Resilient member is provided between the under side of the movable jaw and at least one of the way surfaces to space the movable jaw slightly from the way surfaces until the movable jaw engages a workpiece, at which time the resilient material compresses and provides a positive hold down force on the workpiece.

7 Claims, 4 Drawing Sheets

VISE WITH WORKPIECE HOLD DOWN FORCE

CROSS REFERENCE TO RELATED APPLICATION

This application claims priority on prior copending United States provisional application Ser. No. 60/028,277, filed Oct. 11, 1996.

BACKGROUND OF THE INVENTION

The present invention relates to a workholding vise which is of the type that provides a hold down force through an angled connection from a vise nut onto the movable jaw of the vise, and which is made so that it will be spaced slightly from the support or way surface supporting the movable jaw on the bed of the vise when it is not loaded, and when loaded will exert a positive force through the movable jaw onto a workpiece being clamped against the fixed jaw.

Precision machine vises that are made to provide a hold down force onto a workpiece are sold by Kurt Manufacturing Company, Inc. under the trademark ANGLOCK.

The vise jaw nut provides an angled force on the vise jaw through a part spherical insert that permits jaw self aligning, as well as exerting a downward force on the jaw. An early patent showing this concept is U.S. Pat. No. 2,880,638.

These vises have had a wide acceptance in the trade, and the present invention is to improve the initial hold down force on a workpiece tending to urge the workpiece against the guideway forming a workpiece support surface on the vise bed.

SUMMARY OF THE INVENTION

The present invention relates to a resilient support that will space a movable jaw of a vise slightly from the jaw or guideway on the vise bed when a vise jaw is not unloaded, and when clamped through application of a load which distributes the clamping force horizontally and vertically toward the movable jaw guideway surface, will cause part of the vertical force to urge the workpiece toward the guideway surfaces on the vise bed, which also support the workpiece.

A resilient member spaces the under surface of the moveable jaw slightly above the guideway or way surface on the rails of the vise. The guideway surfaces are on the top of the side rails. When the movable jaw is tightened, the connection between the vise screw and the jaw causes the downward force to seat the jaw positively onto the way surfaces of the rails and in so doing impart a downward force toward the rails on the workpiece being clamped. The jaw is moved against the way surfaces in opposition to the resilient force.

In the form shown, the resilient force can be generated by O-rings, or elastomeric materials that are seated either in the way surface or in the jaw surfaces, and when under no load the resilient material will protrude slightly beyond the plane of the adjacent surface so that the material will cause a space between the way surfaces of the vise rails and the support surface or under surface of the movable jaw.

DETAILED DESCRIPTION OF THE PREFERRED EMBODIMENTS

Figure 1:
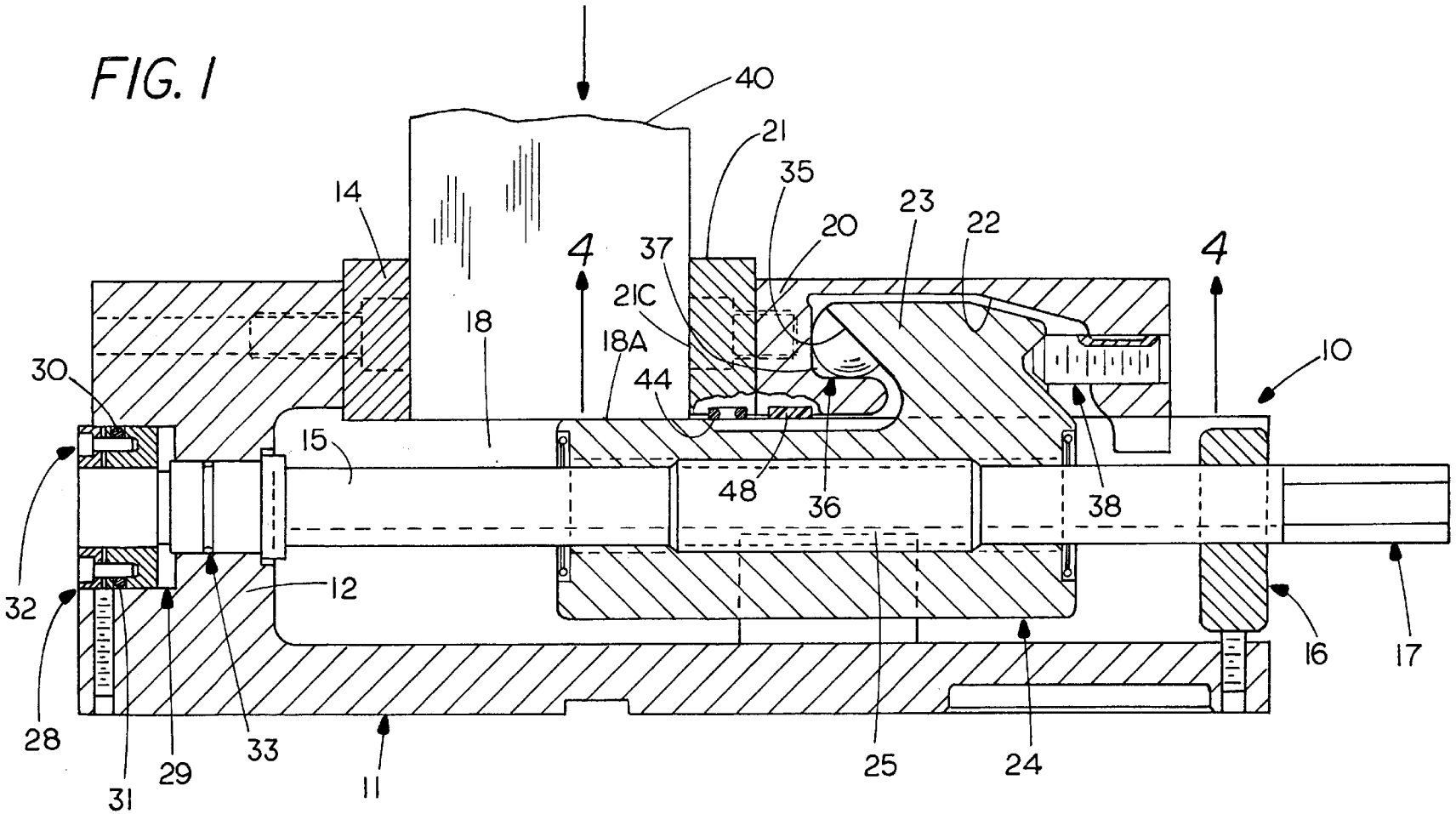
FIG. 1 is a sectional view of a typical vise utilizing the jaw connection that provides a downward force and including the improvement according to the present invention shown schematically.

FIG. 1 is a sectional view through a typical vise indicated generally at 10, which has a vise body 11 of conventional design and which includes, in this form of the invention, a fixed block 12 at one end that forms a fixed jaw having a fixed jaw plate 14 that is mounted stationarily relative to the vise body 11. A vise screw 15 is rotatably held in the fixed block 12 in a suitable manner, and the screw can be rotated relative to this fixed end. The vise screw is supported at the opposite end with a suitable screw support 16, as shown, and the screw has a handle connection end 17 for a drive handle.

The vise body 11 includes a pair of side rails 18, which have upper way surfaces 18A that support a movable jaw 20. The movable jaw includes a jaw plate 21. The movable jaw 20 is formed in a conventional manner for this type of vise and includes a receptacle 22 on the underside that receives a head portion 23 of a jaw nut 24. The jaw nut 24 has a threaded opening that receives a screw threaded portion 25 of the screw 15, so that the nut can be threaded longitudinally along the screw 15 to move the movable jaw plate 22 of the movable jaw toward the fixed jaw plate 14.

The screw 15 is held in place in the fixed block 12 with a retaining nut 28, which bears against a thrust bearing 29 in a recess 30 in the block 12. A suitable O-ring 31 can be provided for keeping dirt out of the recess, and the nut 28 can be covered with a plate held in place with small screws 32. An O-ring 33 also seals the shaft portion of the vise screw 15 in a bore in the block 12 through which the end of the vise screw passes.

The head 23 of the jaw nut 24 has an inclined forward face indicated at 35 that bears against a spherical segment load applying member 36 of conventional design. This is seated in a suitable receptacle shown at 37 on the forward wall of the movable jaw 20. The movable jaw 20 is held in place on the nut by having a set screw 38 threaded into the back wall of the movable jaw and bearing against the rear side of the head 23 of the nut.

Figure 2:
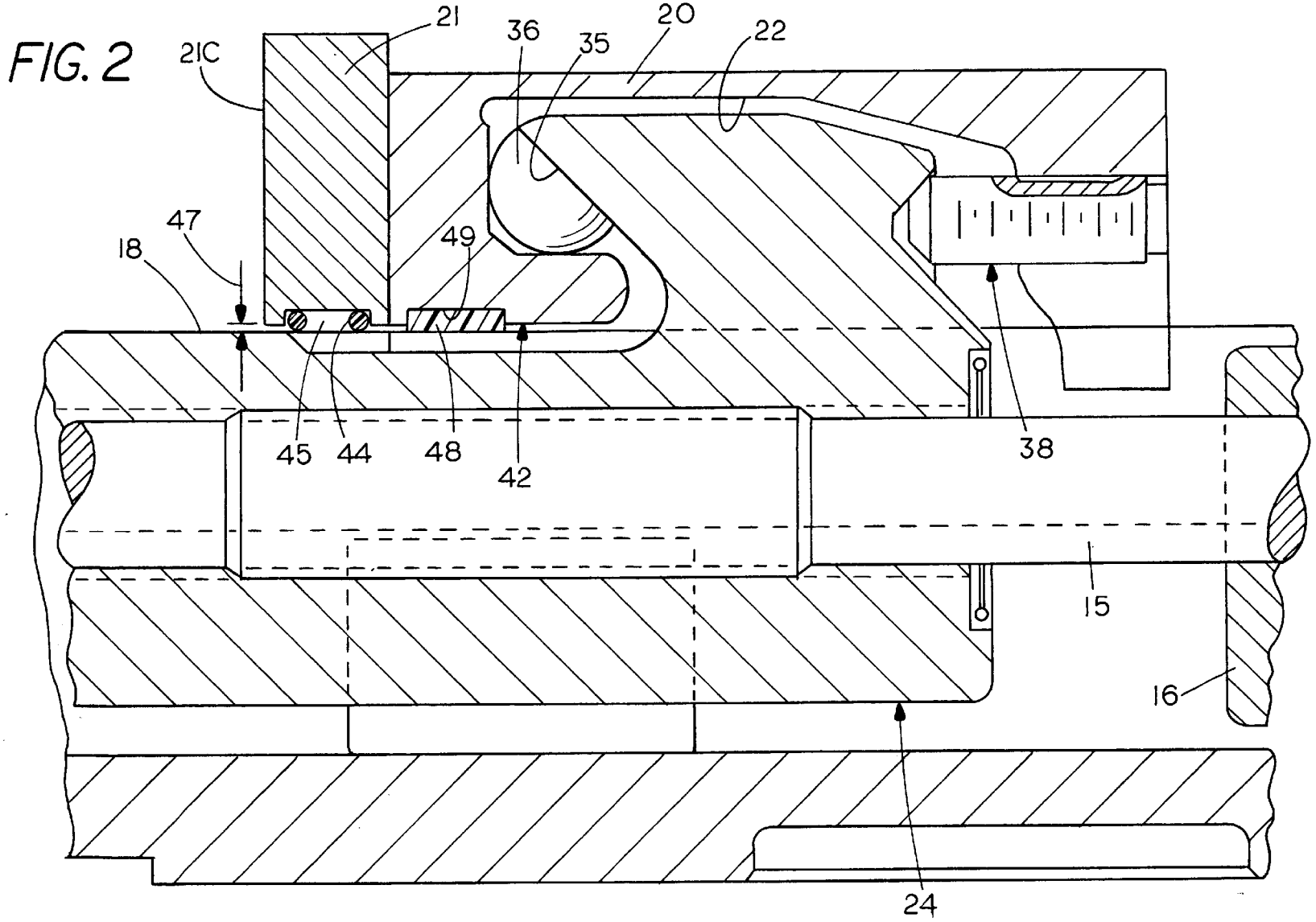
FIG. 2 is an enlarged sectional view showing the resilient members when the jaw is not under load.

When the vise screw 15 is threaded in a direction to close the movable jaw 20, the surface 35 bears on the spherical segment 36 to load the movable jaw 20 and move it toward the fixed jaw plate 14. A workpiece represented schematically at 40 in FIG. 1 is then forced toward the fixed jaw 14. In the present invention, as shown in FIG. 2, the under surface 42 of the movable jaw is spaced from the guideway or way surface 18. This gap is illustrated by the double arrows 47 in FIG. 2.

This gap can be formed, in the form shown in FIG. 2, by providing an O-ring 44 in a recess 45 in the movable jaw plate 21, and by providing a suitable block of elastomeric material shown at 48 in a recess 49 formed on the underside of the movable jaw 20 itself.

The spacing is indicated by the double arrows 44 and can be just a few thousandths if desired, or in the range of 1/16th of an inch or so. The amount of the gap can be at any desired level that will accomplish the purposes of the present invention.

As the movable jaw 20 is tightened on the workpiece the surface 21C of the jaw plate engages the workpiece and as the component of force from the jaw nut acts to move the movable jaw toward ways 18A, the force acts also on the workpiece through friction.

Figure 3:
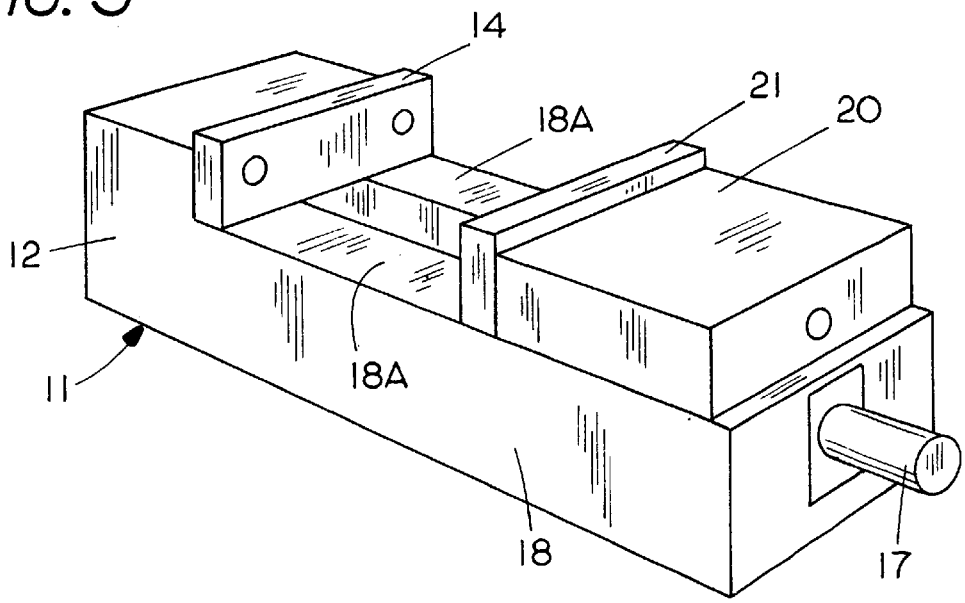
FIG. 3 is a schematic top perspective view of a typical vise.

In FIG. 3, a schematic perspective view of a typical vise as illustrated to show the positioning of the rails 18, which are spaced apart as shown. The rails 18 are part of the vise body 11, and the ways 18A are flat surfaces against which the underside of the movable jaw 20 will be forced when it is under load.

Figure 4:
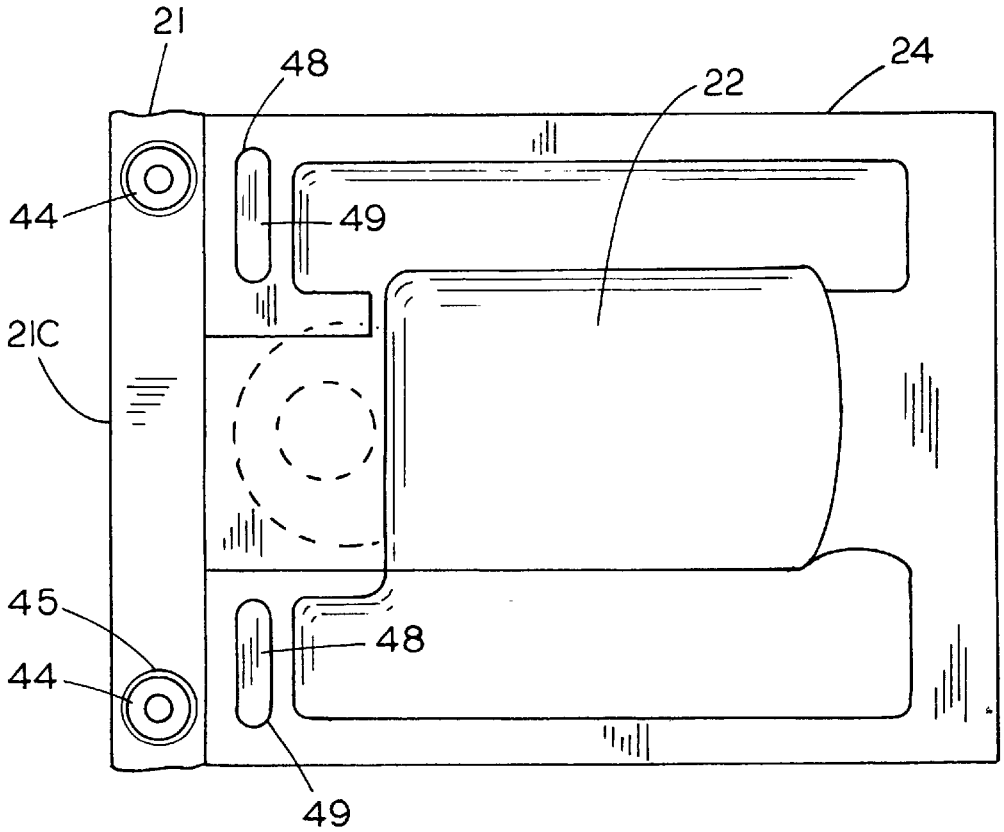
FIG. 4 is a bottom plan view of a typical jaw used with this type of a vise, schematically showing pockets for receiving resilient members, such as O-rings.

In FIG. 4, the movable jaw is shown from its bottom side, taken generally on line 3—3 in FIG. 1, and it shows that the insert material 48 can be filled into the recess 49, the recess can be elongated laterally on the surfaces that support the forward end of the movable jaw 20. The movable jaw 20 is only shown schematically. The recess 22 for the jaw nut is indicated in FIG. 3.

The jaw plate 21 has the O-rings 44 shown in position, and these will bear on the ways 18A of the rails 18, as the movable jaw 21 is moved toward the fixed jaw 14. The recesses 49 and the recesses 45 can be positioned in any desired location above the way surfaces 18A. The recesses 45 can be eliminated, and the resilient material or biasing force members positioned on the movable jaw only such as that shown at recesses 49. The recess and resilient material can be placed in the rails and protrude up from the way surfaces 18A.

Figure 5:
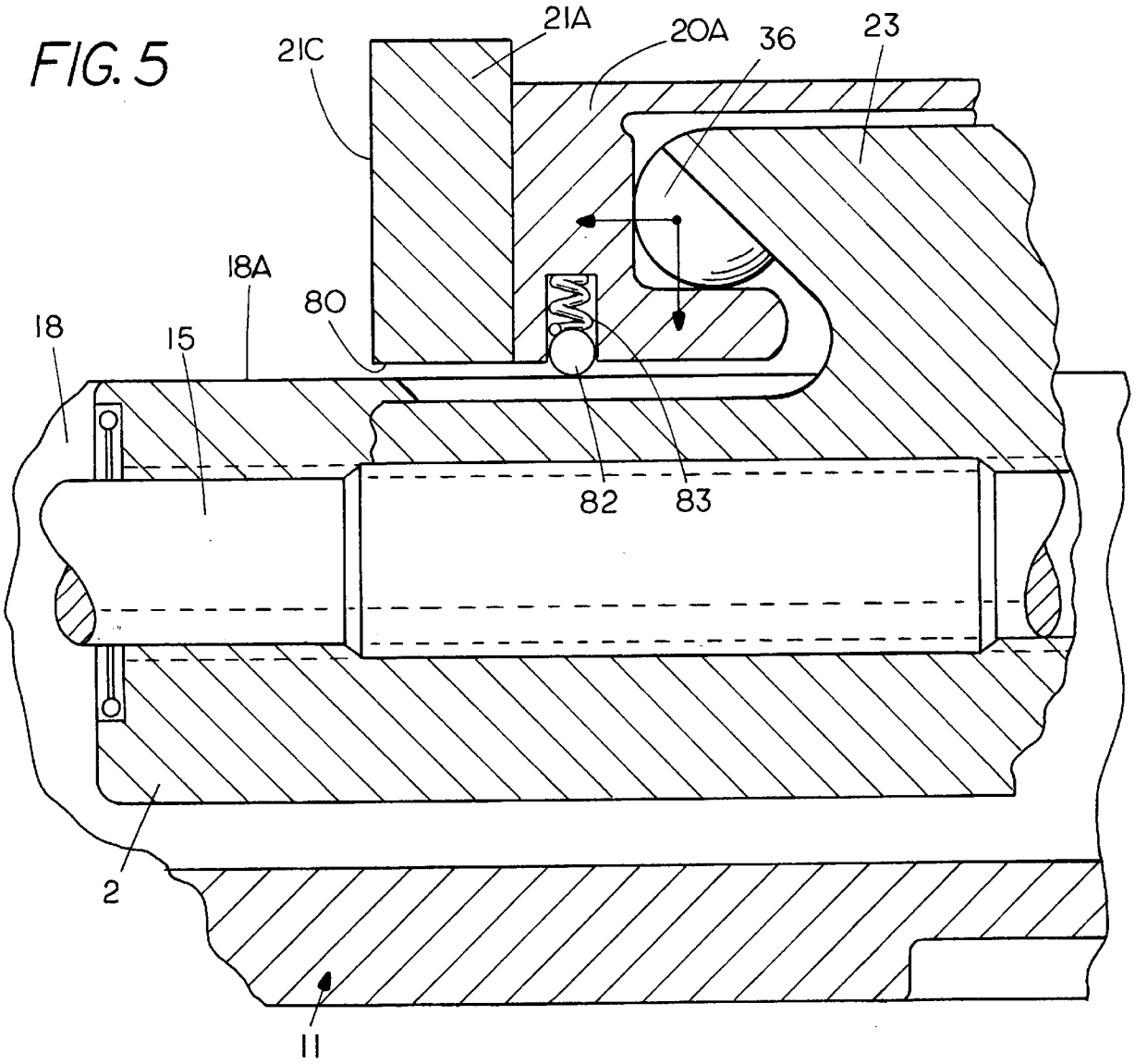
FIG. 5 is a fragmentary sectional view of the forward end of a movable jaw similar to that shown in FIG. 1 having a spring loaded ball that is used for providing a resilient force to lift the movable jaw slightly when unloaded.

In FIG. 5 a modified form of the invention is shown that uses a different biasing or resilient force for spacing the jaw from way surfaces 18A. In this form of the invention, a movable jaw 20A which is constructed substantially the same as the jaw 20 in the first form of the invention is used to support a jaw plate 21A, and is driven by the jaw nut 24, which is identical to that shown in the first form of the invention. The nut 24 is driven by the screw 15, and provides the downward force, substantially as shown by the vectors on a spherical segment 36 in FIG. 5. In this form of the invention, the under surface indicated at 80 of the movable jaw plate 21 and the movable jaw 20A as supported away from the way surface 18A utilizing a resiliently mounted commercially available plunger or ball insert 82 that is threaded into a suitable opening in the movable jaw 20A. The ball is urged outwardly by a spring 83 a selected distance. The ball 82 and spacing 83 is a purchased component that is threaded into the bottom of the jaw. The ball 82 is retained from coming out of the receptacle housing the spring 83 more than a selected distance. As shown, the ball will bear against the surface 18A and raise the bottom of the movable jaw 20 a selected distance so that when the jaw is tightened, the component of force toward the way surface 18A will act to provide a downward force against a workpiece where the movable jaw 21A and the workpiece interface, that is along the jaw plate surface 21C shown in FIG. 5. The ball assembly can be placed into the rail 18 if desired. The ball would protrude slightly above the way surface 18A. The ball will roll to permit the jaw to move.

The gap that is illustrated between the under surface 80 and the way surface 18A in FIG. 5 will be diminished to zero when the workpiece is clamped in the movable jaw. This will pull the workpiece into its intended rest position securely against the way surfaces 18A. The resilient material can be any selected material, or as shown a spring loaded ball or plunger can be used.

It is understood that this concept of utilizing a downward force applying jaw can be used with clamps, or other devices, and it is not restricted to machine vises. For example, the same principal could apply in a wedge type clamp where the wedge is moved to clamp a jaw and applies force in two directions. In other words, the working face of the nut that is illustrated at 35 could be essentially a wedge acting against a mating surface to clamp parts together.

The spring loaded ball that is shown could be replaced with a piece or plug of elastomeric material that would provide a biasing force, or other commercial spring loaded members.

Although the present invention has been described with reference to preferred embodiments, workers skilled in the art will recognize that changes may be made in form and detail without departing from the spirit and scope of the invention.

What is claimed is:

1. A vise having a body with guide ways forming at least one way surface, a movable jaw having a lower surface on a lower side supported on the way surface and guided on the way surface for movement relative to a fixed jaw, the movable jaw being operated with direct contact by a jaw nut that exerts a downward force directly on the movable jaw as the movable jaw is clamped against a workpiece, a resilient member mounted on the lower side of the movable jaw and positioned to extend from the lower surface and between the movable jaw and the way surface adjacent the movable jaw face to provide a gap between a lower surface of the movable jaw and the way surface adjacent the jaw face when the movable jaw is unloaded, said nut acting directly on a surface of the movable jaw between the jaw face and an opposite end of the movable law for providing a clamping force against a workpiece and for compressing the resilient member to provide a downward force against an engaged surface of a workpiece, the forces to provide the gap being provided solely between the lower side of the movable jaw and the way surface.

2. The vise of claim 1, wherein the resilient member comprises an elastomeric member sliding directly on a way surface.

3. The vise of claim 1, wherein the movable jaw has a recess in the lower surface for receiving the jaw nut, and a head member including a load applying segment for providing the clamping force between the jaw nut and the movable jaw at a leading edge of the jaw, the head member directly contacting a portion of the movable jaw, and a retainer for retaining the movable jaw on the jaw nut at a trailing end of the movable jaw.

4. The vise of claim 1, wherein said resilient member comprises a spring loaded ball mounted in a recess in the lower surface of the movable jaw.

5. The vise of claim 1, wherein said resilient member comprises an elastomeric member mounted in a cavity in the lower surface of said movable jaw and extending below a plane defined by the lower surface of the movable jaw when the movable jaw is in an unloaded position.

6. A vise body having a pair of side rails, said side rails having at least one upper surface, a unitary body movable jaw supported on the upper surface, an actuator acting directly on the unitary body of the movable law for actuating said movable jaw to clamp a workpiece against a fixed jaw on the vise body, said actuator providing a force on the movable jaw having components substantially parallel to and perpendicular to the upper surface, and an elastomeric member mounted in a cavity on a lower surface of said movable jaw to space the lower surface of the movable jaw from the upper surface of the side rail when the jaw is unloaded and compressing under load from the actuator.

7. The vise of claim 6, wherein said movable jaw includes a jaw plate, and a separate resilient member on an under surface of said jaw plate to provide a resilient force to lift the jaw and the jaw plate from the way surface when the jaw is unloaded.

* * * * *

UNITED STATES PATENT AND TRADEMARK OFFICE

CERTIFICATE OF CORRECTION

PATENT NO. : 5,975,513

DATED : November 2, 1999

INVENTOR(S) : Ingo E. Wolfe

It is certified that error appears in the above-identified patent and that said Letters Patent is hereby corrected as shown below:

Claim 1, line 26 , delete "law" and insert --jaw--

.

Signed and Sealed this

Nineteenth Day of September, 2000

*Attest:*

Q. TODD DICKINSON

*Attesting Officer*

*Director of Patents and Trademarks*